US006341842B1

(12) United States Patent
Beach et al.

(10) Patent No.: US 6,341,842 B1
(45) Date of Patent: Jan. 29, 2002

(54) SURFACE MODIFIED NOZZLE PLATE

(75) Inventors: Bradley Leonard Beach; Sean David Smith; Jing X. Sun, all of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/564,148

(22) Filed: May 3, 2000

(51) Int. Cl.[7] ..... B41J 2/135
(52) U.S. Cl. ..... 347/45
(58) Field of Search ..... 347/45, 47

(56) References Cited

U.S. PATENT DOCUMENTS

| | | | |
|---|---|---|---|
| 5,010,356 | A | 4/1991 | Albinson |
| 5,119,116 | A | 6/1992 | Yu |
| 5,121,134 | A | 6/1992 | Albinson et al. |
| 5,136,310 | A | 8/1992 | Drews |
| 5,208,604 | A | 5/1993 | Watanabe et al. |
| 5,212,496 | A | 5/1993 | Badesha et al. |
| 5,218,381 | A | 6/1993 | Narang et al. |
| 5,442,240 | A | 8/1995 | Mukerji |
| 5,598,193 | A | 1/1997 | Halko et al. |
| 5,646,657 | A | 7/1997 | Aoki |
| 5,770,271 | A | 6/1998 | Imamura |
| 5,859,654 | A | 1/1999 | Radke et al. |
| 5,910,372 | A | 6/1999 | Griffin et al. |
| 6,151,045 | A | 11/2000 | Beach et al. |

FOREIGN PATENT DOCUMENTS

| | | |
|---|---|---|
| EP | 367438 | 5/1990 |
| EP | 495649 | 7/1992 |
| EP | 521697 | 1/1993 |
| JP | 63-197653 | 8/1988 |
| JP | 05-162312 | 6/1993 |

*Primary Examiner*—John Barlow
*Assistant Examiner*—Michael S. Brooke
(74) *Attorney, Agent, or Firm*—John A. Brady

(57) ABSTRACT

The invention relates to an ink jet printer nozzle plate containing nozzle holes and having a durable non-wettable layer on at least one surface thereof. The nozzle plate includes a polyimide material and the non-wettable layer contains a derivative of an amine-terminated silane compound, the amine-terminated silane compound derivative being covalently bound to the polyimide material of the nozzle plate. The layer also contains a derivative of a polydialkylsiloxane compound having a number average molecular weight ranging from about 400 to about 150,000 and an end group reactive with the amine-terminated silane compound derivative. The polydialkylsiloxane compound derivative is bound to the amine-terminated silane compound derivative by a condensation reaction to provide the durable non-wettable layer on the surface of the nozzle plate. Because of covalently bonding the silane and polydialkylsiloxane materials to the polyimide, the non-wettable layer remains substantially durable throughout the life of a printhead containing the nozzle plate.

11 Claims, 3 Drawing Sheets

VIEW B–B

SURFACE MODIFIED NOZZLE PLATE

FIELD OF THE INVENTION

The invention relates to ink-jet printers and, in particular, to surface modified nozzle plates for printheads which exhibit modified wettability characteristics.

BACKGROUND OF THE INVENTION

Ink jet printer technology continues to improve to provide faster printers which produce higher quality print. In order to achieve these goals, printhead materials, designs and manufacturing procedures continue to change and evolve. In newer printhead designs, the nozzle plates contain smaller, more closely spaced nozzle holes and increased numbers of nozzle holes per nozzle plate. As the size and spacing of the nozzle holes decreases and the need for increased production increases, it becomes increasing difficult to provide relatively inexpensive printheads which function to provide quality print over the life of the printhead.

One of the problems which may occur during a printing operation is that ink accumulates on the nozzle plate surface adjacent the nozzle holes. Tile accumulated ink can, over time, partially block and cause misdirection of ink droplets ejected from the nozzle plate or, in a severe case, totally block ink ejection from the affected nozzle hole. An excess accumulation of ink on the nozzle plate adjacent a nozzle hole during firing of a nozzle is often referred to in the art as "flooding" since the ink may actually accumulate to the point that it covers the nozzle holes. Another accumulation of ink on the nozzle plate is the result of ink pooling. "Pooling" is defined as the accumulation of ink on the nozzle plate when a "tail" of ink forms as the ink droplet is ejected and the ink tail breaks away from the main droplet and deposits back on the nozzle plate. Pooling of ink does not necessarily occur only adjacent the nozzle holes and may occur anywhere on the nozzle plate.

In addition to interfering with ink ejection from a printhead, ink accumulation on a nozzle plate of a multicolor printhead whether from flooding or pooling may result in ink color mixing. As a result of ink color mixing, the ink droplets ejected from affected nozzle holes may not provide the intended color dots thereby reducing print quality. As nozzle holes and their associated ink ejection heaters become smaller and the distance between adjacent nozzle holes is reduced to provide higher quality, faster printing, the effects of ink accumulation or flooding of the nozzle plates becomes a more important factor in the operation of the printer.

Attempts have been made to control nozzle flooding and pooling by applying certain fluorocarbon coatings to the nozzle plates. For example, U.S. Pat. No. 5,010,356 to Albinson describes a method for reducing the wettability of the surface of a substrate by providing an adherent layer of fluorosilane to an ink jet recording head. According to the method, a first layer of cured siloxane is formed on the surface and a second layer containing a fluorosilane group including a hydrolyzable group is applied to the first layer. The first siloxane layer is said to be cured (i.e., polymerized) on the surface by baking the coating at 50° C. for thirty minutes, followed by baking at 45° C. for thirty minutes and 95% relative humidity. The fluorosilane layer was said to be applied to the siloxane coated surface of the polyimide sheets in a dessicator which had a pressure of 50 torr pressure and a relative humidity of less than 10%. After applying the fluorosilane layer to the siloxane coated polyimide sheets, the dessicator was placed in an oven for 2 hours at 180° C. After baking, the dessicator was cooled for 15 minutes, reconnected to a vacuum pump and evacuated while it continued to cool. The dessicator was then pressurized to room pressure using dry nitrogen gas. It was said that the non-wetting properties of the coated polyimide were still apparent after 1,000 strokes of a cotton bud soaked in tripropylene glycol monomethyl ether solvent.

Despite advances in the art of nozzle plate manufacture, the use of a siloxane layers and/or fluorosilane layers and conventional coating techniques to modify nozzle plate wettability have not been found to provide durable coatings for nozzle plates which remain effective over the life of the printheads which may include thousands of cleaning cycles. Conventional wettability modification coatings may be readily removed or rendered ineffective by techniques used to clean the printheads long before achieving the expected printhead life. Thus there remains a need for improved wettability modification coatings which are sufficiently durable to remain effective over the life of the printheads.

SUMMARY OF THE INVENTION

With regard to the above and other objects and advantages, tile invention provides an ink jet printer nozzle plate containing nozzle holes and having a durable non-wettable layer on at least one surface thereof. The surface heaving the non-wettable layer is positionable adjacent a media to be printed. The nozzle plate includes a polyimide material and the non-wettable layer contains a derivative of an amine-terminated silane compound, the amine-terminated silane compound derivative being covalently bound to the polyimide material of the nozzle plate. The layer also contains a derivative of a polydialkylsiloxane compound having a number average molecular weight ranging from about 400 to about 150,000 and an end group reactive with the amine-terminated silane compound derivative. The polydialkylsiloxane compound derivative is bound to the amine-terminated silane compound derivative by a condensation reaction to provide the durable non-wettable layer on the surface of the nozzle plate.

In another aspect, the invention provides a method for modifying surface wettability of a polymeric nozzle plate for an ink jet printer. According to the method, an amine-terminated silane compound is applied to at least a portion of a first surface of a nozzle plate made of polyimide material. The nozzle plate and the amine-terminated silane compound are heated for a period of time under conditions sufficient to covalently bond the amine-terminated silane compound to the polyimide material. Next, a polydialkylsiloxane compound is reacted with the covalently bound amine-terminated silane compound to provide a durable non-wettable layer on the first surface of the polyimide nozzle plate.

In yet another aspect, the invention provides a method for treating a first surface of a polyimide material to render the first surface substantially repellent to ink. The method includes applying an amine-terminated silane compound to a first surface of the polyimide material and heating the amine-terminated silane compound and polyimide material to a temperature sufficient to form covalent bonds between the amine-end groups and the polyimide material. A polydialkylsiloxane compound is applied to the covalently bound silane compound and the polyimide material containing the covalently bound silane compound and the polydialkylsiloxane compound are heated to a temperature sufficient to effect a condensation reaction between the covalently bound silane compound and the polydialkylsiloxane compound producing a durable non-wettable layer on the surface of the polyimide material. The durable non-wettable layer has a thickness ranging from about 0.5 to about 7 microns. The preferred polydialkylsiloxane compound has a number average molecular weight ranging from about 400 to about 140,000.

In an alternative embodiment, a mask is applied to the durable non-wettable layer on the nozzle plate to mask an annular area around the nozzle holes in the nozzle plate and certain unmasked areas are reactive ion etched (RIE) to increase their wettability. This provides areas on the nozzle plate which are wettable and areas which are non-wettable by the ink thereby improving excess ink removal during the printhead cleaning steps.

An advantage of the durable non-wettable layer and methods of the invention is that an effective non-wettable layer may be provided on a nozzle plate which has increased durability over the life of the printhead. Without desiring to be bound by theoretical considerations, it is believed the increased durability of the non-wettable layer is due, at least in part, to covalent bonds which are formed between the silane compound and the polyimide material of the nozzle plate as a result of the relatively high reaction temperature. Covalent bonds are formed when the polyimide and silane are heated to a temperature sufficient to open the ring structure of the polyimide so that a reactive end group on the silane can bond with the polyimide ring structure. The polydialkylsiloxane compound condensed to the silane compound derivative on the polyimide material further increases the durability of the coating by increasing the effective thickness of the non-wettable layer. Si—O—Si bonds are formed between the silane and polydialkylsiloxane compounds at elevated temperatures due to the presence of reactive end groups oil the silane and/or polydialkylsiloxane compound. The resulting non-wettable layer is particularly resistant to damage or removal during printhead cleaning operations using a wiper as described herein.

BRIEF DESCRIPTION OF THE DRAWINGS

Further advantages of the invention will become apparent by reference to the detailed description of preferred embodiments when considered in conjunction with the following drawings, which are not to scale so as to better show the detail, in which like reference numerals denote like elements throughout the several views, and wherein.

DETAILED DESCRIPTION OF THE INVENTION

Figures 1A, 1B, 1C:
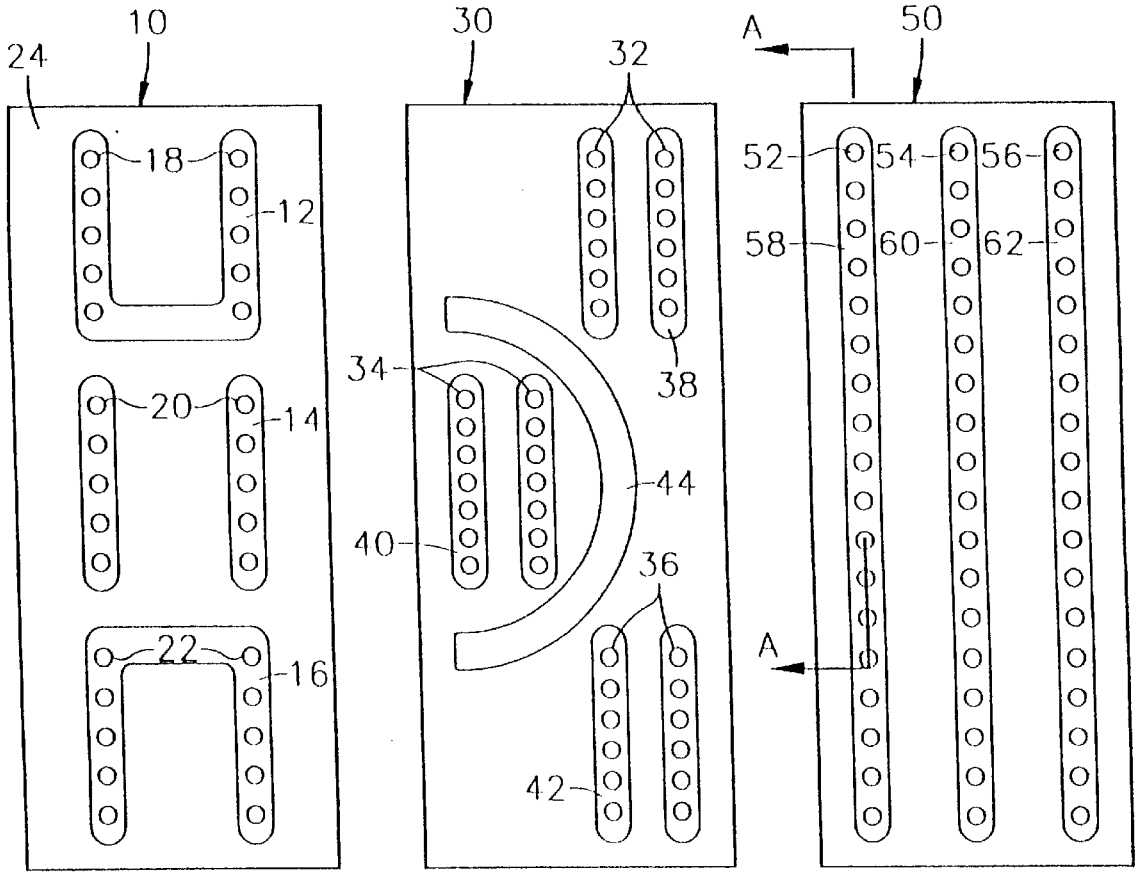
FIGS. 1A, 1B and 1C are plan top views of nozzle plates containing surface-energy modifying layers according to the invention.

In a preferred embodiment of the invention, a nozzle plate for an ink jet printer is provided which includes a surface-energy modifying layer on at least a portion of a first surface of the nozzle plate positioned adjacent media to be printed. For modern ink jet printers, the nozzle plates are typically polymeric materials, most preferably polyimide materials. Polyimide is a relatively hydrophobic material and has an untreated surface-energy of about 45 dynes. However, for ink jet printing applications, a lower surface-energy, preferably lower than about 40 dynes and most preferably lower than about 30 dynes is desirable in order to reduce ink flooding and build up of dried ink or debris on the nozzle plate adjacent the nozzle holes.

In order to lower the surface-energy of the polyimide material, a surface of the polyimide may be treated to provide a layer having desired wettability properties. Because polyimide is relatively inert to chemical attack, coating materials have been widely used to reduce the surface-energy of the nozzle plates. However, coatings typically must be reapplied periodically and are often not durable enough to last for the life of the printhead.

As an alternative to coating the polyimide nozzle plate with a non-wettable material, the polyimide may be reacted with or etched under certain conditions to provide reactive sites for chemical modification of the surface properties thereof. For example, the polyimide may be exposed to a strong base such as potassium hydroxide or sodium hydroxide for a sufficient period of time at an elevated temperature, and then rinsed and neutralized with a dilute acid. As a result of this treatment, carboxyl groups are formed at the surface of the polyimide. The carboxyl groups may be reacted with epoxies, hydrazines, alcohols and the like as described more fully in U.S. Pat. No. 5,133,840 to Buchwalter et al., the entire disclosure of which is incorporated by reference as if fully set forth herein.

A particularly preferred method for lowering the surface-energy of a polyimide nozzle plate is to contact the polyimide material with a compound having at least one terminal group which is reactive with the polyimide and then cause the end group to react with the polyimide under conditions sufficient to form a relatively strong chemical bond between the polyimide and the end group of the compound. For polyimide nozzle plate materials, the end group of the compound is preferably a basic end group, most preferably an amine end group which is basic enough at an elevated temperature to open the imide ring of the polyimide to form an amide bond therewith.

Accordingly, it is preferred to react a polyimide nozzle plate with an amine-terminated silane compound, more preferably an aminoalkyl-terminated alkoxysilane compound. The aminoalkyl-terminated alkoxysilane compound is preferably selected from the group consisting of (aminoethylaminomethyl)phenethyltrimethoxysilane, aminopropyltriethoxysilane, 3-(m-aminophenoxy) propyltrimethoxysilane and p-aminophenyltrimethoxysilane. The most preferred aminoalkyl terminated silane compound for reaction with the polyimide material is (aminoethylaminomethyl)-phenethyltrimethoxysilane.

While the foregoing amine-terminated polydialkylsiloxane compounds are particularly useful for lowering the surface energy of a polyimide material, it is difficult to obtain a thickness of more than about a micron of the non-wettable layer on the polyimide material. Accordingly, although the surface energy modifying layer made with a covalently bound silane compound is more durable than conventional coatings, it is desirable to further improve the durability of such surface energy modifying layer.

It has been discovered that an increased thickness of non-wettable layer may be obtained by reacting the covalently bound amine-terminated silane compound with a halogen-free polydialkylsiloxane compound having reactive end groups thereon. The preferred polydialkylsiloxane compound is a halogen-free polydialkylsiloxane having at least one terminal silanol group thereon. The halogen-free polydialkylsiloxane compound preferably has a number average molecular weight ranging from about 400 to about 150,000, most preferably from about 130,000 to about 145,000. A particularly preferred polydialkylsiloxane compound is a silanol terminated polydimethyl siloxane (STPDS) of the formula

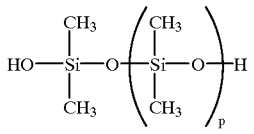

wherein p is an integer ranging from about 4 to about 2000, and is available from Gelest, Inc. of Tullytown, Pa. under the trade designation DMS-S51.

In order to modify the surface-energy of the polyimide nozzle plate using the silane compound and polydialkylsiloxane compound as described above, a polyimide film is treated according to the invention with the silane and polydialkylsiloxane compounds prior to coating an opposing surface of the polyimide film with an adhesive. This is because adhesives typically used to attach a nozzle plate to a silicon semiconductor chip would be cured by the temperatures in the range used to react the silane and polydialkylsiloxane compound with the polyimide material. It is preferred, though not required, to activate the surface of the polyimide material by means of an oxygen plasma treatment prior to coating the surface with the silane compound in order to improve the adhesion of the silane compound to the polyimide material prior to the reaction step.

The silane compound may be applied to the polyimide material by spin coating the polyimide with solution of the silane compound in ethanol at a speed of 2500 rpm for one minute. The silane compound concentration in ethanol preferably ranges from about 0.03 to about 0.1 % by weight of the solution. The silane compound coating and polyimide material are then heated under conditions sufficient to cause reaction between reactive end groups of the silane compound and the polyimide material. A preferred temperature for reacting the silane compound with the polyimide material is from about 135° to about 200° C, most preferably from about 150° to about 200 ° C. The reaction temperature is preferably maintained for a period of time ranging from about 5 minutes to about 1 hour. After reacting the silane compound and polyimide material, the polyimide film is preferably washed to remove excess silane, preferably with an alcohol wash. Under the conditions described above, a mono-layer of covalently bound silane is preferably formed having a thickness ranging from about 500 Angstroms to less than about 0.1 microns. During the reaction, atmospheric moisture preferably reacts with the methoxy groups of the covalently bound silane compound to form silanol groups.

Next a halogen-free polydialklsiloxane, preferably STPDS having a number average molecular weight ranging from about 400 to about 150,000, preferably from about 130,000 to about 145,000 and most preferably about 139,000 is applied to the covalently bound silane layer on the polyimide material. The polydialkylsiloxane is solvent coated onto the covalently bound silane layer, the coating having a thickness preferably ranging from about 0.5 to about 7 microns. A spin coating technique is preferably used to apply the polydialkylsiloxane to the covalently bound silane layer wherein the solvent for the polydialkylsiloxane is selected from xylene or tetrahydrofuran and the polydialkylsiloxane concentration preferably ranges from about 0.1 to about 2.0% by weight.

After coating the covalently bound silane compound with the polydialkylsiloxane compound, the polyimide material is again heated under conditions sufficient to form a bond between the polydialkylsolixane compound and the covalently bound silane layer. The reaction is preferably a condensation reaction which is believed to produce very little if any cross-linking between the silane layer and the polydialkylsiloxane compound. Reaction conditions are similar to the conditions used to react the silane compound with the polyimide. Accordingly a preferred reaction temperature for conducting the reaction between the polydialkylsiloxane compound and the covalently bound silane compound is from about 135° C to about 200° C, the most preferably from about 150° to about 200° C. The reaction temperature is preferably maintained for a period of time ranging from about 5 minutes to about 1 hour. The reaction is preferably conducted at atmospheric pressure in ambient room atmosphere. After reacting the polydialkylsiloxane compound and covalently bound silane compound, the polyimide film is optionally washed to remove excess polydialkylsiloxane, preferably with an alcohol wash. The thickness of the resulting non-wettable layer preferably ranges from about 0.5 to about 7 microns, most preferably from about 2 to about 3 microns. washed to remove excess polydialkylsiloxane, preferably with an alcohol wash. The thickness of the resulting non-wettable layer preferably ranges from about 0.5 to about 7 microns, most preferably from about 2 to about 3 microns.

Because of its relatively high molecular weight of the polydialkylsiloxane compound, a relatively thin non-wettable layer provides a substantial decrease in the surface-energy of the polyimide. Whereas the untreated polyimide may have a surface-energy of about 45 dynes, treatment of the surface of the polyimide under the conditions described herein has been found to lower the surface-energy to less than about 30 dynes, preferably less than about 25 dynes and most preferably to a range of from about 15 to about 20 dynes.

It is not necessary to react the entire polyimide film surface wish the surface-energy modifying compounds. Selective application of the compounds to one or more portions of the surface of the polyimide material may be suitable to sufficiently reduce the surface-energy of selected areas of a nozzle plate made from the polyimide material. Accordingly, the silane compound may be selectively applied to polyimide film by a variety of techniques including spraying, dipping, spin coating, brushing, and the like with or without the use of a mask. However, from a practical and production point of view, it is easier to react the entire surface of the polyimide material and then to remove or modify portions of the non-wettable layer as described in more detail below.

After forming the non-wettable layer on the polyimide film, an adhesive layer is applied to an opposing surface of the polyimide film opposite the surface containing the non-wettable layer. The adhesive layer is preferably a B-stageable thermal cure resin, including but not limited to, phenolic resins, resorcinol resins, epoxy resins, ethylene-urea resins, furane resins, polyurethane resins, silicone resins and the like, which are used to fixedly attach the polyimide material to a silicon substrate. A preferred adhesive is a phenolic/butryal adhesive which is effective to attach a nozzle plate made from the polyimide film to a silicon semiconductor chip. After coating the polyimide material with the adhesive, a protective tape is applied to the non-wettable coating and a sacrificial polyvinyl alcohol (PVA) layer is applied to the adhesive layer. The polyimide film is then slit and sprocketted to a size suitable for use in making nozzle plates. The flow features including nozzle holes, firing chambers and ink flow channels are then laser ablated in the polyimide film from the adhesive side thereof.

After ablating the flow features in the film, the sacrificial PVA layer is removed with water thereby carrying away debris formed during the ablation process. Individual nozzle plates are then excised from the film and tacked to the semiconductor chips using a thermal compression step. The adhesive is then cured to form a nozzle plate/chip assembly. The completed nozzle plate/chip assembly is then ready for use in making an ink jet pen.

Selected areas of the nozzle plate portion of the nozzle plate/chip assembly which areas are positionable adjacent a print media may optionally be made wettable or more wettable than certain non-wettable areas containing the layers described above. It is preferred to form a pattern of wettable and non-wettable areas on the surface of the nozzle plate as shown in FIGS. 1-A, 1-B and 1-C. As seen in the FIG. 1-A, nozzle plate 10 contains non-wettable areas 12, 14 and 16 which are adjacent nozzle arrays 18, 20 and 22. Area 24 outside of areas 12, 14 and 16 remains substantially more wettable than the non-wettable areas 12, 14 and 16. Nozzle plate 10 may be used for multicolor application of ink to a print media with each array 18, 20 and 22 being used for separate colors or the arrays 18, 20 and 22 may be used together to apply a single color ink to a print media.

In FIG. 1-B, nozzle plate 30 has a different pattern of nozzle arrays. Nozzle arrays 32, 34 and 36 are offset from one another rather than being aligned as in FIG. 1-A. Again, each of the nozzle arrays 32, 34 and 36 may be use to apply a different color to a print media or they may be used together to apply a single color to the media. Non-wettable areas 38, 40 and 42 are preferably provided adjacent the nozzle arrays 32, 34 and 36. In the case of multiple color nozzle arrays, it is particularly preferred to provide a non-wettable area 44 between the nozzle arrays 32, 34 and 36 to further reduce the tendency for ink of different colors accumulating on the nozzle plate surface and mixing.

Yet another nozzle plate 50 containing wettable and non-wettable areas is shown in FIG. 1C. The nozzle plate 50 includes nozzle arrays 52, 54 and 56. As with the previous nozzle plate designs, each of the nozzle hole arrays may be used to apply a single color or a different color ink to a print media. Each of the arrays 52–56 is surrounded by a non-wettable area, 58, 60 or 62, respectively, which effectively reduces the surface-energy of the nozzle plate in the areas surrounding or adjacent the nozzle holes.

In each of the foregoing nozzle plate designs, the annular treated area around the nozzle holes preferably ranges from about 5 to about 100 $\mu$m in width. A preferred annular treated area immediately adjacent each nozzle hole ranges from about 35 to about 50 $\mu$m in width. In FIG. 1B, the annular width of the treated area 44 is about 50 to about 300 $\mu$m wide.

The non-wettable areas as described above effectively repel ink so that it does not tend to accumulate on the surface of the nozzle plate 10, 30 or 50 in the area immediately adjacent the nozzle hole arrays. Because the silane and polydialkylsiloxane are bound to the polyimide material, the treated areas are essentially durable and resist removal during printhead cleaning operations using contact wipers such as wiper blades. For example, nozzle plates containing a monolayer consisting of aminopropyl terminated polydimethyl-siloxane (ATPDMS) were compared with nozzle plates containing a non-wettable layer according to the invention. The nozzle plates were used for dye-based and pigment-based inks. Dye-based inks used in the test are described, for example, in U.S. Pat. No. 5,361,461 to Beach et al. and U.S. Pat. No. 5,981,623 to McCain et al. Pigment-based inks used in the test are described, for example, in U.S. Pat. No. 5,925,692 to Kappele et al. The performance of each of the layers after repeated cleaning cycles using a wiper is shown in the following table.

TABLE

| Nozzle Plate Non-Wettable Layer | Number of Cleaning Cycles with Performance Sustained | |
|---|---|---|
| | Dye-Based Ink | Pigment-Based Ink |
| ATPDMS monolayer | 1,000 | <100 |
| Layer per the Invention | 15,000+ | 15,000+ |

As seen by the foregoing results, a nozzle plate containing a non-wettable layer according to the invention is substantially more durable than a monolayer consisting of ATPDMS over a substantial number of nozzle plate cleaning cycles.

Because the surface-energy modifying layer is only on selected areas of the nozzle plates 10, 30 and 50, ink will tend to accumulate in the untreated areas, such as area 24 of nozzle plate 10. In order to remove ink from the untreated areas, these areas of the nozzle plate may contain channels or ink drain holes or other topography configured to return the ink to the ink supply or to an ink containment structure. The drain holes may be located between the nozzle hole arrays above an ink via region or ink feed region on the semiconductor chip or between the nozzle holes and electrical contact pads adjacent the edge of the semiconductor chip. A wiper may be used in combination with the drain holes to remove excess ink in the area of the drain holes. One method for removing ink from the accumulated areas is described in U.S. Pat. No. 4,542,389 to Allen, incorporated herein by reference as if fully set forth.

Figure 2:
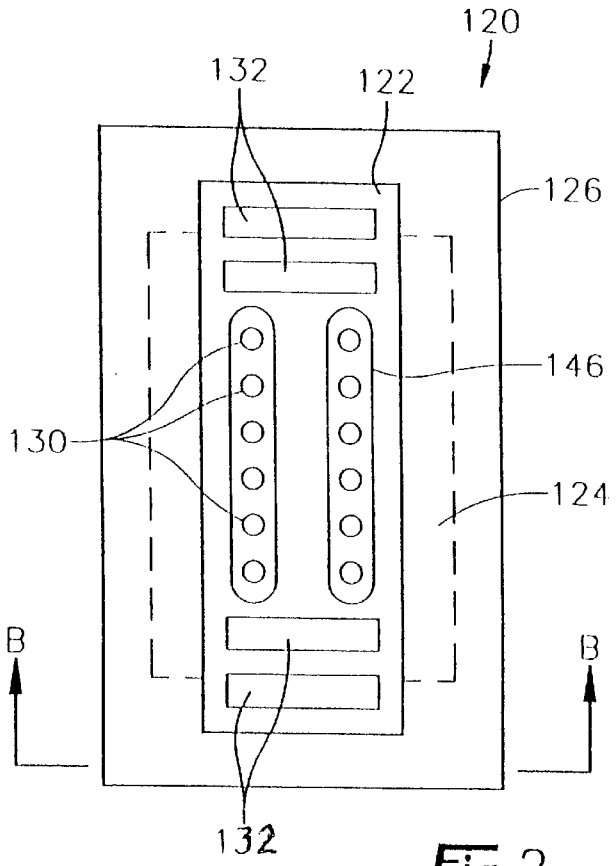
FIG. 2 is a plan top view of a nozzle plate/chip assembly containing surface-energy modifying layers according to the invention.
Figure 3:
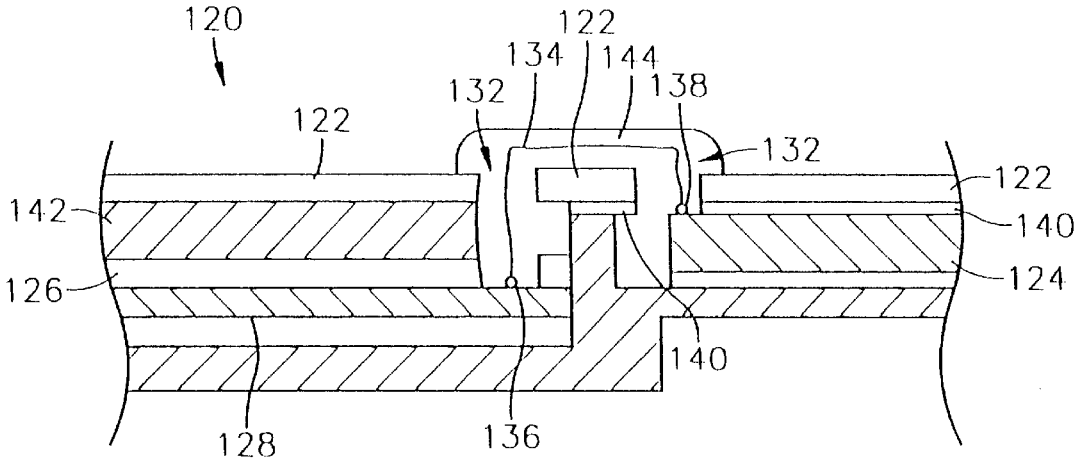
FIG. 3 is a cross-sectional view of a portion of an ink jet pen containing a surface-energy modifying layer according to the invention.

While a non-wettable layer as described herein is particularly useful for modifying the surface-energy of the nozzle plate to prevent ink flooding during printing operations, such non-wettable layer also provide a surface-energy modification useful in other printhead assembly steps. For example, FIGS. 2 and 3 illustrate a printhead 120 for an ink jet printer which includes a nozzle plate 122 attached to a semiconductor silicon chip 124 and a TAB circuit, flex circuit or printed circuit board 126. The TAB circuit, flex circuit or printed circuit board 126 contains electrical traces 128 for electrically connecting ink energizing elements on the chip 124 to a printer for selective ejection of ink from nozzle holes 130.

Electrical connections are typically made by attaching wires or traces 134 from contact pads 136 on the electrical traces 128 to contact pads 138 on the silicon chip 124 through openings or windows 132 in the nozzle plate 122, adhesive layers 140 and 142 and flex circuit material 126 (FIG. 3). Once the electrical connections are completed, an elastomeric encapsulate material 144 is applied adjacent windows 132 to protect the wires 134 and connections to the contact pads 136 and 138. The layer of elastomeric material is preferably no thicker than about b 10mils. Suitable encapsulate materials include silicon polymer coatings halving a coefficient of thermal expansion greater than or equal to that of the wire 134 as well as silicone, polyurethane, and urethane acrylate coatings.

During the application of the encapsulate material 144, there is a tendency for the material to flow or run toward the nozzle holes 130, particularly the nozzle holes 130 closest to windows 132. Accordingly, in order to reduce the tendency for the encapsulate material to flow toward nozzle holes, areas of low surface-energy 146 are provided around the nozzle holes 130. Low surface-energy areas are also preferably provided adjacent windows 132 according to the methods described above.

Figure 4:
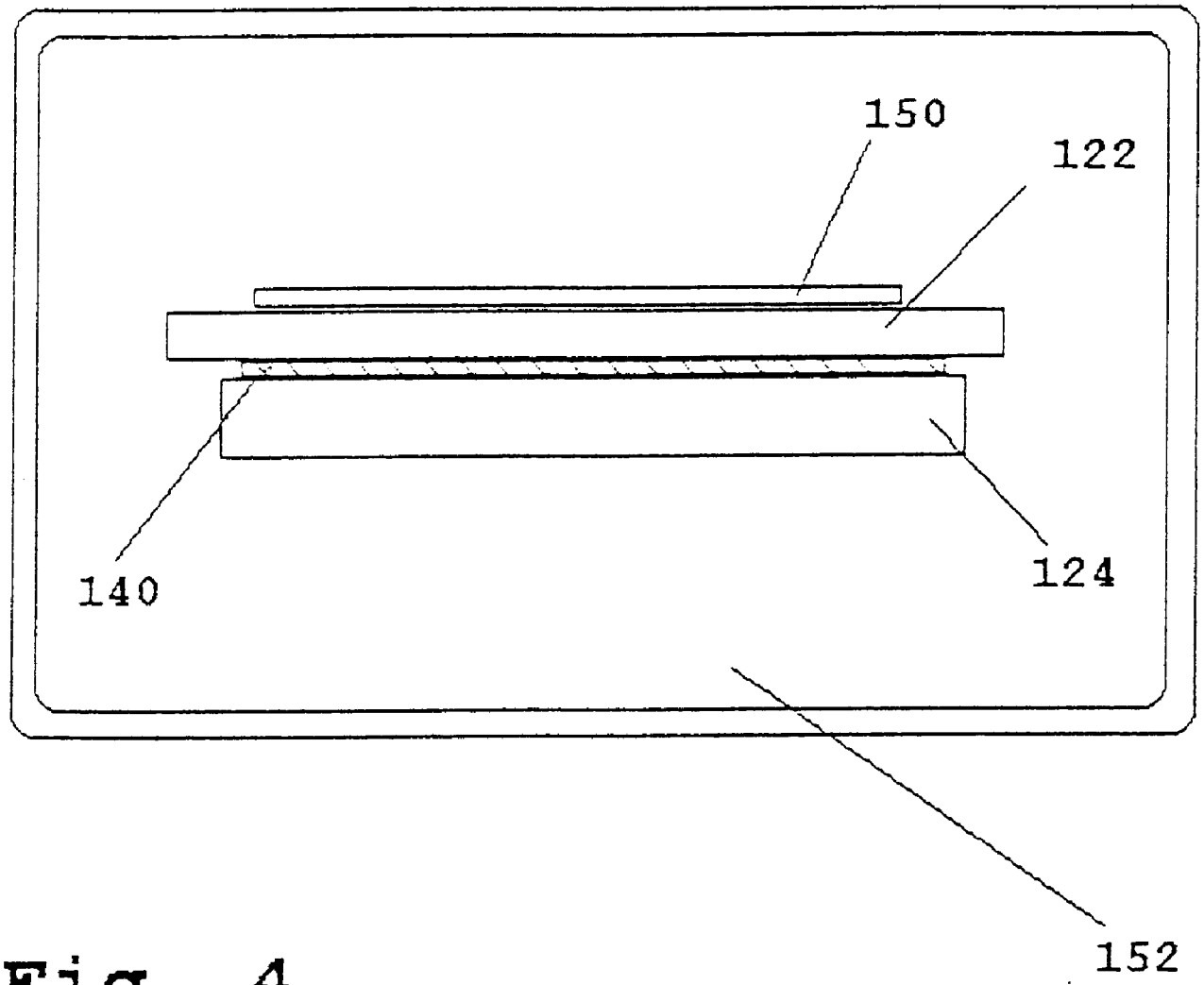
FIG. 4 is a schematic drawing of a process for modifying portions of a nozzle plate to provide areas of wettability and non-wettability according to the invention.

With reference to FIG. 4, a method for patterning the surface energy-modifying layer is described. In this process, a portion of the non-wettable layer is removed and/or converted to a wettable portion. The selected non-wettable areas as described with reference to FIGS. 1-A–1-C, and FIG. 2 are provided by masking areas 12, 14, 16, 38, 40, 42 58, 60, 62 and 146 with a masking material having the patterns as shown in the figures. The masked areas are protected from modification by a mask 150 (FIG. 4) which is preferably made of a stainless steel material. The mask 150 is preferably placed in intimate contact with nozzle plate 122 which is attached by means of the adhesive 140 to a silicon semiconductor substrate or chip 124 as described above. The mask and nozzle plate/chip assembly 122/124 is then placed into a reactive ion etch (RIE) chamber 152 for exposure to a directional plasma which will remove a portion of the non-wettable coating in the areas not protected by the mask. A 300 watt, 100% mass flow of $O_2$ RIE, plasma for 10 seconds is sufficient to remove at least a portion, preferably about 0.1 micron of the non-wettable layer from the nozzle plate 122.

Without being bound by theoretical considerations, it is believed that the $O_2$ RIE plasma converts the exposed areas of the non-wettable layer to a glass-like material having increased wettability properties over the masked areas of the non-wettable layer. In order to increase the hydrophilicity of wettable areas, a 400 watt, 75 mass flow of 02 RIE plasma for 100 seconds may be used. Such conditions remove about 0.4 microns of the non-wettable layer.

Having now described the invention and preferred embodiments thereof, it will be recognized by those of ordinary skill that the invention is capable of numerous modifications, rearrangements and substitutions without departing from the spirit and scope of the invention as defined by the appended claims.

What is claimed is:

1. An ink jet printer nozzle plate of the type containing nozzle holes and having a durable non-wettable layer on at least one surface thereof, said surface being positionable adjacent a media to be printed, the nozzle plate comprising a polyimide material and the non-wettable layer consisting essentially of a derivative of an amine-terminated silane compound, the amine-terminated silane compound derivative being covalently bound to the polyimide material of the nozzle plate and a derivative of a halogen-free polydialkylsiloxane compound having a number average molecular weight ranging from about 400 to about 150,000 and an end group reactive with the amine-terminated silane compound derivative, the polydialkylsiloxane compound derivative being bound to the amine-terminated silane compound derivative by a condensation reaction to provide the durable non-wettable layer on the surface of the nozzle plate.

2. The nozzle plate of claim 1 wherein the amine-terminated silane compound comprises an amine-terminated alkoxysilane compound.

3. The nozzle plate of claim 2 wherein the amine-terminated alkoxysilane compound derivative covalently bound to the polyimide has a thickness ranging from about 500 Angstroms to less than about 0.1 micron.

4. The nozzle plate of claim 2 wherein the amine-terminated alkoxysilane compound is selected from the group consisting of (aminoethylaminomethyl) phenethyltrimethoxysilane, aminopropyltriethoxysilane, 3-(m-aminophenoxy)propyltrimethoxysilane and p-aminophenyltrimethoxysilane.

5. The nozzle plate of claim 4 wherein the amine-terminated alkoxysilane compound comprises (aminoethylaminomethyl)phenethyltrimethoxysilane.

6. The nozzle plate of claim 1 wherein the polydialkylsiloxane compound derivative in the non-wettable layer has a thickness ranging from about 0.5 to about 7 microns.

7. The nozzle plate of claim 1 wherein the polydialkylsiloxane compound comprises a halogen-free silanol-terminated polydialkysiloxane compound.

8. The nozzle plate of claim 1 wherein the polydialkylsiloxane compound is a compound of the formula

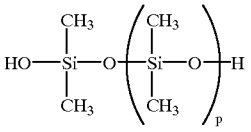

wherein p is an integer ranging from about 4 to about 2000.

9. The nozzle plate of claim 1 wherein the polydialkylsiloxane compound has a number average molecular weight ranging from about 130,000 to about 145,000.

10. The nozzle plate of claim 1 containing wettable and non-wettable areas.

11. The nozzle plate of claim 10 wherein the non-wettable area is adjacent the nozzle holes so that an annular non-wettable area around the nozzle holes ranges from about 5 to about 100 microns in width.

* * * * *